US007009333B2

(12) United States Patent
Hwang et al.

(10) Patent No.: US 7,009,333 B2
(45) Date of Patent: Mar. 7, 2006

(54) STRUCTURE OF ELECTRON GUN FOR COLOR CATHODE RAY TUBE

(75) Inventors: Cheol Ho Hwang, Gumi-si (KR); Moon Sik Kim, Gyeongsangbuk-do (KR); Ki Tae Kim, Gumi-si (KR); Dong Young Kim, Gumi-si (KR)

(73) Assignee: LG.Philips Display Korea Co., Ltd., Gyeongsangbuk (KR)

( * ) Notice: Subject to any disclaimer, the term of this patent is extended or adjusted under 35 U.S.C. 154(b) by 135 days.

(21) Appl. No.: 10/678,071

(22) Filed: Oct. 6, 2003

(65) Prior Publication Data

US 2004/0145295 A1 Jul. 29, 2004

(30) Foreign Application Priority Data

Jan. 27, 2003 (KR) ..... 2003-5368

(51) Int. Cl.
*H01J 29/50* (2006.01)

(52) U.S. Cl. ..... 313/414; 313/409; 313/452

(58) Field of Classification Search ..... 313/409–415, 313/447, 449, 441, 428, 432, 452; 315/368.16, 315/5.34, 382, 382.1
See application file for complete search history.

(56) References Cited

U.S. PATENT DOCUMENTS

| | | | | |
|---|---|---|---|---|
| 4,629,933 | A | 12/1986 | Bijma et al. | |
| 5,747,922 | A * | 5/1998 | Sukeno et al. | 313/412 |
| 6,184,617 | B1 | 2/2001 | Choi | |
| 2002/0101161 | A1 * | 8/2002 | Song et al. | 315/5.31 |

FOREIGN PATENT DOCUMENTS

| | | |
|---|---|---|
| JP | 2002-008558 | 1/2002 |
| KR | 1998-0186554 | 12/1998 |
| KR | 2002-0057585 | * 7/2002 |

OTHER PUBLICATIONS

English translation of 2002-0057585.*

* cited by examiner

*Primary Examiner*—Edward J. Glick
*Assistant Examiner*—Elizabeth Keaney
(74) *Attorney, Agent, or Firm*—McKenna Long & Aldridge LLP

(57) ABSTRACT

A cathode ray tube with a reduced beam spot size on a fluorescent screen is obtained by forming electron beam passing holes on the electrodes composing a triode portion of an electron gun to have horizontally and vertically asymmetric shapes.

22 Claims, 16 Drawing Sheets

STRUCTURE OF ELECTRON GUN FOR COLOR CATHODE RAY TUBE

This application claims the benefit of Korean Patent Application No. 2003-5368 filed on Jan. 27, 2003, which is hereby incorporated by reference for all purposes as if fully set forth herein.

BACKGROUND OF THE INVENTION

1. Field of the Invention

The present invention relates to a cathode ray tube, and more particularly, to a structure of an electron gun for a color cathode ray tube, capable of minimizing an electron beam spot size formed on a fluorescent screen by forming asymmetrical electron beam passing holes of a cathode that composes a triode portion of the electron gun.

2. Discussion of the Related Art

FIG. 1 is a diagram explaining the structure of a cathode ray tube of the related art, and FIG. 2 is a diagram explaining the structure of an electron gun of the related art.

The cathode ray tube is composed of a panel 50 having a fluorescent screen 15 formed on an inner surface of the panel, a funnel 60 coupled to the panel 50, forming an evacuated envelope, an electron gun 80 for emitting electron beams 13, the electron gun 80 being housed in a neck portion 7 of the funnel 60, a deflection yoke 12 for deflecting the electron beams emitted from the electron gun 80 in the horizontal and vertical directions, and a shadow mask 14 with a color selecting function, the shadow mask 14 being disposed at a predetermined distance from the fluorescent screen 15.

Further, there is an inner shield 20 for shielding the electron beams 13 from the influence of external magnetic fields, a mask frame 18 welded to the inner shield 20 for supporting the shadow mask 14, and a mask spring 17 for attaching the mask frame 18 to the panel 50.

With reference to FIG. 2, the electron gun 80 is composed of a cathode 3, a first electrode 4 for controlling the amount of electron beams emitted from the cathode 3, a second electrode 5 for accelerating the electron beams, the second electrode 5 being disposed at predetermined distances from the first electrode, a third electrode 6, a fourth electrode 7, a fifth electrode 8, a sixth electrode 9, and a shield cup 10, in which the third electrode through the shield cup are disposed at predetermined distances from the second electrode 5 in the cited order.

Also, a BSC 11 is attached to the shield cup 10 for electrically coupling the electron gun 80 to the funnel 60 in a more secure manner.

The following describes operation of the electron gun 80 and the cathode ray tube. First of all, the electron gun 80 emits electrons from a surface of the cathode 3 when a designated voltage is applied through the stem pin 1 that is connected to a built-in heater 2 inside the cathode 3. The electrons are controlled by the first electrode 4 also called a control electrode, and accelerated by the second electrode 5 also called an accelerating electrode. Part of the electron beams 13 are focused and accelerated by a focus lens disposed between the second electrode 5, the third electrode 6, the fourth electrode 7, and the fifth electrode 8, and most of the electron beams 13 are focused and accelerated by a main lens interposed between the fifth electrode 8 and the sixth electrode 9, eventually being emitted from the electron gun 80.

The electron beams 13 emitted from the electron gun 80 are then deflected in the horizontal and vertical directions by a deflection magnetic field formed by the deflection yoke 12. The electron beams 13 undergo a color selection process by the shadow mask 14 and are scanned in regular sequence on the fluorescent screen 15, where the electron beams display a designated image.

Usually, the voltage applied to the first electrode 4 (Vg1) is 0V, and the voltages applied to the second through fourth electrodes 5, 6, and 7 (Vg2) range from 400 to 1000V, and the voltage applied to the fifth electrode 8 (Vf) ranges from 6000 to 10000V. In addition, a dynamic voltage is applied to at least one of the third electrodes through the fifth electrodes.

FIG. 3 is a diagram explaining the electron beam passing holes on the first electrode composing the triode portion of the electron gun, and FIG. 4 is a diagram explaining the electron beam passing holes on the second electrode composing the triode portion of the electron gun.

FIG. 3 depicts the electron beam passing holes 41 on the first electrode 4. Although the electron beam passing holes 41 can be in diverse shapes, FIG. 3 shows rectangular shaped electron beam passing holes 41.

In the drawing, v4 denotes a vertical size of the electron beam passing hole 41, and h4 denotes a horizontal size of the electron beam passing hole 41.

Similarly, FIG. 4 depicts electron beam passing holes 41 on the first electrode 4. Again, the electron beam passing holes 51 may have diverse shapes, such as, a circle or oval, but FIG. 4 illustrates a rectangular shaped electron beam passing holes 51. In the drawing, v5 denotes a vertical size of the electron beam passing hole 51, and h5 denotes a horizontal size of the electron beam passing hole 51. Even though they are not shown, electron beam passing holes on the third electrode may be circular. As depicted in the drawings, the horizontal sizes h4 and h5 and the vertical sizes v4 and v5 for the electron gun are nearly much identical for both the first electrode 4 and the second electrode 5.

There have been attempts to reduce the horizontal sizes h4 and h5 and the vertical sizes v4 and v5 of the electron beam passing holes 41 and 51 hoping to reduce the spot size of the electron beam 13 formed on the fluorescent screen 15. However, tremendous high precision would be necessary to reduce the horizontal sizes h4 and h5 and/or the vertical sizes v4 and v5 of the electron beam passing holes 41 and 51, and it is not easy to fabricate such electrode. In fact, this only shortened the life of the cathode 3.

As an alternative, some tried to make one size (it could be either the horizontal size or the vertical size) relatively larger than the other. When it was done so, however, the spot size of the electron beam 13 was enlarged along the direction of the larger size, and this phenomenon is not favorable to a high definition cathode ray tube. For instance, it is a well known fact that when the horizontal size h4 of the electron beam passing hole on the first electrode 4 is larger than the vertical size v4 of the electron beam passing hole, the spot size formed on the fluorescent screen 15 is enlarged in the horizontal direction, and this eventually deteriorates image quality. In general, the spot size of the electron beam on the fluorescent screen is influenced by several factors including lens magnification, repulsive space charge (electric) force, and spherical aberration of the main lens. Among the factors, the lens magnification does not have much effect on the spot size (Dx), and its utility as a design element of the electron gun is very low because there are basic parameters like voltage, focal length, and length of the electron gun that are not supposed to be changed. On the other hand, the influence of the repulsive space charge force on the spot size (Dst) may indicate a phenomenon that the spot size (Dst) is enlarged due to the repulsion and the collision between electrons in the electron beam. To obviate such phenomenon, a special design is needed to increase an angle in which the electron beams travel (hereinafter, it is referred to as 'emission angle'). This may be accomplished by reducing the vertical size v4 and the horizontal size h4 of the electron beam passing hole 41 on the first electrode 4.

The influence of the spherical aberration of the main lens on the spot size (Dic) may indicate a phenomenon that the spot size (Dic) is enlarged due to the difference between focal lengths of an electron that passed through a short axis of the lens and an electron that passed through a long axis of the lens. Unlike the repulsive space charge force, if the beam emission angle on the main lens is small, the spot size on the fluorescent screen 15 may be reduced. To summarize the above discussion, the spot size (Dt) on the fluorescent screen 15 may be expressed as follows:

$$Dt=\sqrt{(Dx+Dst)^2+Dic^2}$$

Another example of a method for reducing the spot size is to increase the size of the main lens. According to this method, the spot size does not get bigger just because of the spherical aberration in the main lens, even when an electron beam with a large emission angle is emitted. Rather, it is possible to make the spot size on the fluorescent screen very small using this method because the repulsive space charge force decreases when passing through the big main lens. In other words, the repulsive space charge force and the spherical aberration in the main lens can be minimized simply by using a bigger main lens.

There is though a limit to the size of the main lens. The main lens should not be larger than a predetermined size, and it may not be easy either to make the main lens large. As an alternative, the emission angle of the triode portion, besides the main lens, may be increased. To increase the emission angle at the triode portion, the size of the electron beam passing holes 41 and 51 on the first electrode 4 and the second electrode 5, respectively, should be reduced. However, reducing the size of the electron beam passing holes 41 and 51 may result in the deterioration of the life of the cathode 3. To overcome the above problem, some have used an impregnated cathode for sustaining the life of the cathode 3. However, this only increases the cost. Reducing the size of the electron beam passing holes 41 and 51 may also effect the alignment characteristic and further reduce the yield of the cathodes in addition to reducing the life of the cathodes.

FIG. 5 is a diagram explaining horizontal sizes of the electron beam passing holes on the first and second electrodes composing the triode portion of the electron gun, and FIG. 6 is a diagram explaining vertical sizes of the electron beam passing holes on the first and second electrodes composing the triode portion of the electron gun. As shown in FIGS. 5 and 6, the horizontal size h4 of the electron beam passing hole may be substantially identical with the vertical size v4 of the electron beam passing hole on the first electrode 4, or the horizontal size h4 may be slightly larger than the vertical size v4. As the horizontal size h4 of the electron beam passing hole on the first electrode 4 is slightly larger than the vertical size v4, the spot size is also laterally elongated. Similarly, the horizontal size h5 of the electron beam passing hole may be substantially identical with the vertical size v5 of the electron beam passing hole on the second electrode 5, or the horizontal size h5 may be slightly larger than the vertical size v5. As the horizontal size h5 of the electron beam passing hole on the second electrode 5 is slightly larger than the vertical size v5, the spot size is also laterally elongated. However, because the first electrode 4 and the second electrode 5 may act as a quadropolar electrode, vertically elongating the electron beams 13, the electron beams 13 may be substantially elongated in the vertical direction even before they pass through the main lens. The moment the electron beams 13 pass through the main lens, they may again be laterally elongated. Hence, by the time the electron beams strike the fluorescent screen 15, the horizontal size and vertical size of the beam spot may be almost same. In this manner, small-sized electron beam spots may be formed on the fluorescent screen 15. However, if the horizontal sizes h4 and h5 and the vertical sizes v4 and v5 of the electron beam passing holes on the first electrode 4 and the second electrode 5 were asymmetric to each other for the purpose of increasing such effect, that is, if the vertical sizes v4 and v5 are relatively smaller than the horizontal sizes h4 and h5, it would only drastically shorten the life of the electron gun.

For this reason, the ratio of the horizontal sizes h4 and h5 to the vertical sizes v4 and v5 of the first electrode 4 and the second electrode 5 of the triode portion in the electron gun may not be larger than 1.3. That is, the horizontal sizes h4 and h5 may be slightly larger than the vertical sizes v4 and v5. As discussed before, reducing the horizontal sizes h4 and h5 and the vertical sizes v4 and v5 of the electron beam passing holes on the first electrode 4 and the second electrode 5 may reduce the life of the electron gun and may cause a fatal defect to the alignment of the electrode assembly, consequently lowering the yield. Also, reducing the horizontal sizes h4 and h5 and the vertical sizes v4 and v5 of the electron beam passing holes on the first electrode 4 and the second electrode 5 may not help to reduce the spot size of the electron beam.

As in the related art, trying to reduce the electron beam passing holes formed on the first electrode 4 and the second electrode 5 to keep abreast with a trend to large-sized and high definition cathode ray tubes may result in reducing the life of the cathode 3. Further, if the electron gun is adapted to the cathode ray tube, the spot size on the fluorescent screen may be enlarged because the deflection force is stronger on the periphery of the screen than the central portion of a big screen of the cathode ray tube.

FIG. 7 is a diagram explaining the relation between the spot formed on the central portion of the screen and current density in the cathode ray tube. As the graph illustrates, in the structure of the electron gun for the known cathode ray tube, the slope of the current density of the peripheral portion and central portion of the electron beams formed on the central portion of the screen may be smooth because the spot sizes of the electron beams are large. Therefore, the structure of the electron gun may not be adaptable to cathode ray tubes with high definition and high brightness.

SUMMARY OF THE INVENTION

Accordingly, the present invention is directed to structure of electron gun for color cathode ray tube that substantially obviates one or more of the problems due to limitations and disadvantages of the related art.

An advantage of the present invention is to solve at least the above problems and/or disadvantages and to provide at least the advantages described hereinafter.

Another advantage of the present invention is to solve the foregoing problems by providing a cathode ray tube having a high brightness and a reduced spot size on a front surface of the screen, to meet the demands of improving the focus characteristics on a high definition and wide-angled screen.

The foregoing and other advantages may be realized by providing a cathode ray tube mounted with an electron gun including: a triode portion consisting of a cathode, and a first and second electrodes for controlling and accelerating electron beams emitted from the cathode, and a plurality of focus electrodes for focusing the electron beams, wherein a ratio of a vertical size to a horizontal size of an electron beam passing hole formed on the first electrode ranges from 1.5 to 4.3.

To achieve these and other advantages and in accordance with the purpose of the present invention, as embodied and broadly described a cathode ray tube has an electron gun, including: a triode portion consisting of a cathode, and a first and second electrodes for controlling and accelerating electron beams emitted from the cathode, and a plurality of focus electrodes for focusing the electron beams, wherein a ratio of a vertical size to a horizontal size of an electron beam passing hole formed on the first electrode ranges from 1.5 to 4.3; and a vertical size of an electron beam passing hole formed on the second electrode is greater than a horizontal size of the same.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

The advantages of the present invention may be realized and attained as particularly pointed out in the appended claims.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF ILLUSTRATED EMBODIMENTS

Reference will now be made in detail to an embodiment of the present invention, example of which is illustrated in the accompanying drawings.

Figure 8:
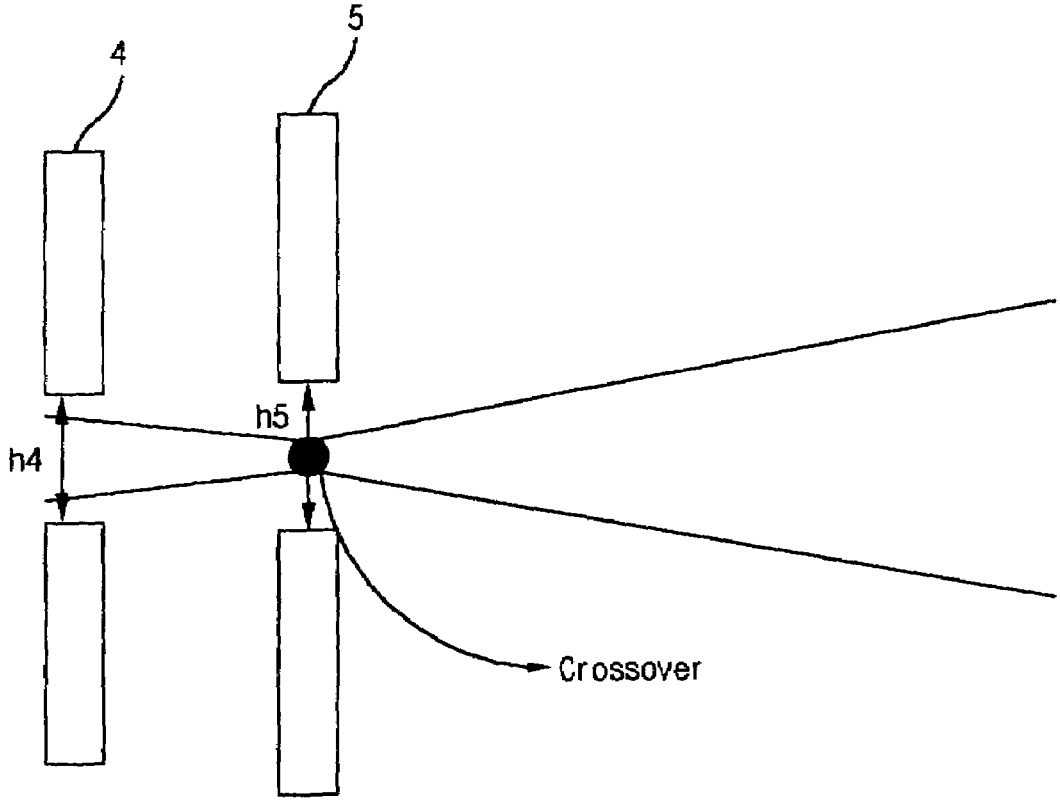
FIG. 8 is a diagram explaining the horizontal sizes of electron passing holes on a first electrode and a second electrode composing a triode portion of an electron gun for a cathode ray tube according to the present invention.
Figure 9:
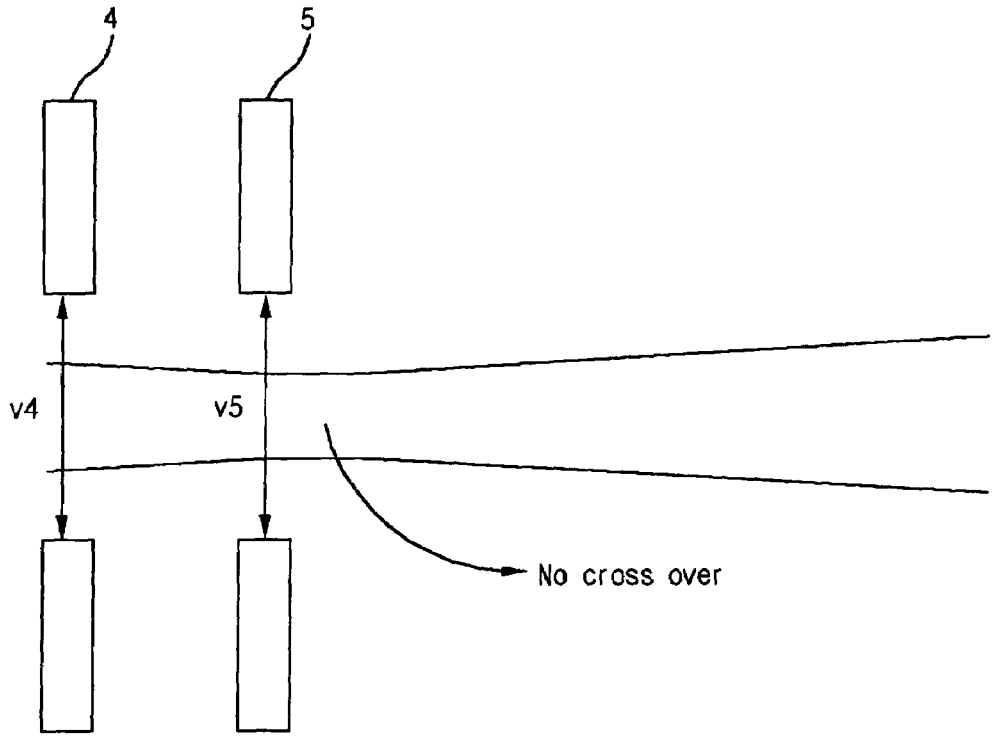
FIG. 9 is a diagram explaining the vertical sizes of electron passing holes on the first electrode and the second electrode composing the triode portion of the electron gun for a cathode ray tube according to the present invention.

FIG. 8 is a diagram explaining the horizontal sizes of electron passing holes on a first electrode 4 and a second electrode 5 composing a triode portion of an electron gun for a cathode ray tube according to the present invention, and FIG. 9 is a diagram explaining the vertical sizes of electron passing holes on the first electrode 4 and the second electrode 5 composing the triode portion of the electron gun for a cathode ray tube according to the present invention.

Suppose that 'h4' and 'v4' denote the horizontal size and the vertical size of an electron beam passing hole on the first electrode 4 of the electron gun for the cathode ray tube according to the present invention, and 'h5' and 'v5' denote the horizontal size and the vertical size of an electron beam passing hole on the second electrode 5 of the electron gun. As shown in the drawings, the vertical size v4 of the electron beam passing hole formed on the first electrode 4 may be relatively larger than the horizontal size h4 of the same. Also, the vertical size v5 of the electron beam passing hole formed on the second electrode 5 may be relatively larger than the horizontal size h4 of the same.

Unlike the related art, in which a spot size formed on a fluorescent screen was reduced by reducing the sizes of electron beam passing holes formed on the first electrode 4 and the second electrode 5, or by enlarging the horizontal size and reducing the vertical size, the present invention suggests a new method for reducing the spot size by making the vertical sizes v4 and v5 much larger than the horizontal sizes h4 and h5, without changing the horizontal sizes h4 and h5 of the electron beam passing holes formed on the first electrode 4 and the second electrode 5. More specifically, the ratio of the vertical size v4 of the electron beam passing hole formed on the first electrode 4 to the horizontal size h4 may be in the range of 1.5 to 4.3. Further, the ratio of the vertical size v5 of the electron beam passing hole formed on the second electrode 5 to the horizontal size h5 may be greater than or equal to 1.5. In short, the horizontal sizes and vertical sizes of the electron beam passing holes satisfy the following relations:

$$4.3\times h4 \geqq v4 \geqq 1.5\times h4;\ \text{and}$$

$$v5 \geqq 1.5\times h5$$

If the vertical size v4 of the electron beam passing hole formed on the first electrode 4 is comparatively larger than the horizontal size h4, the cross over gets larger and the spot size is also enlarged. However, if the vertical size v4 of the electron beam passing hole gets larger than a designated ratio to the horizontal size h4, the cross over disappears and the spot size is reduced. For instance, when the vertical size v4 of the electron beam passing hole is at least 1.5 times larger than the horizontal size h4 of the same, there is no more cross over and the spot size is reduced. However, if the vertical size v4 of the electron beam passing hole is larger than the designated ratio to the horizontal size h4, the spot size is gradually enlarged, and if the vertical size v4 of the electron beam passing hole is at least 4.3 times larger than the horizontal size h4 of the same, the electron beams collide with the electrode. In another embodiment of the present invention, the ratio of the vertical size v4 of the electron beam passing hole formed on the first electrode 4 to the horizontal size h4 may be in the range of 1.9 to 3.5, to minimize the spot size on the screen. The horizontal size h4 and the vertical size v4 may satisfy the following relationship:

$$3.5\times h4 \geqq v4 \geqq 1.9\times h4.$$

As described above, the size of the electron beam passing hole does not need to be reduced in order to reduce the spot size of the electron beam. Instead, the spot size of the electron beam may be reduced more readily by increasing the vertical size v4 of the electron beam passing hole to be greater than 1.5 times or 1.9 times of the horizontal size h4 of the electron beam passing hole to eliminate cross over. Because the size of the electron beam passing hole is not being reduced, problems associated with the shortened life span of the electron gun, difficulties of manufacturing the electron gun, and reducing the spot size may be resolved by adopting the present invention.

Figure 10:
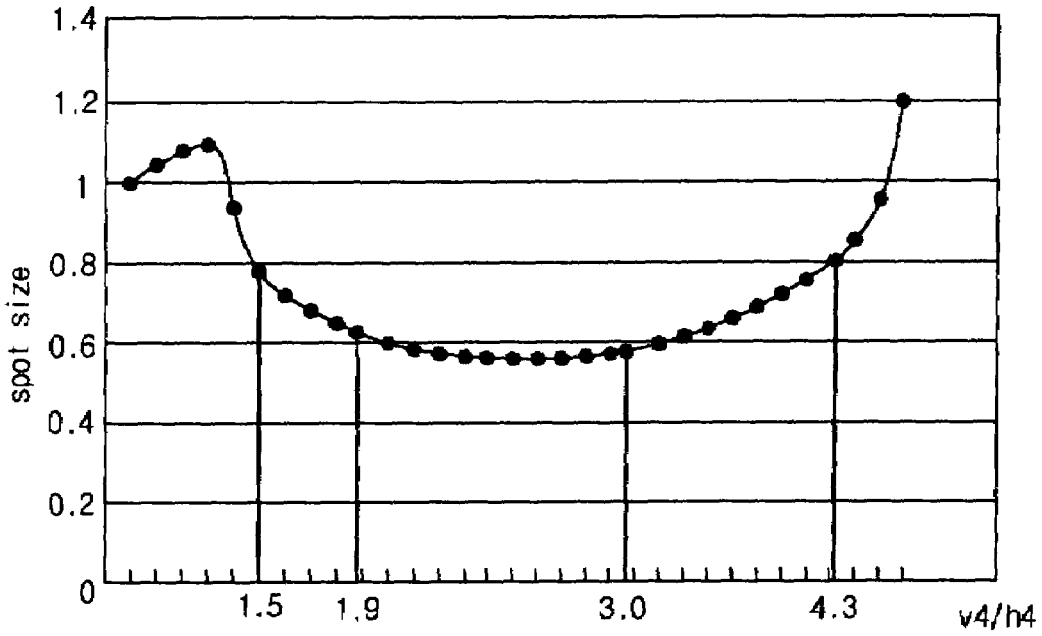
FIG. 10 is a diagram explaining the relationship between the spot size and the ratio of the vertical size (v4) of the electron beam passing hole to the horizontal size (h4) of the electron beam passing hole formed on the first electrode 4 in the cathode ray tube according to the present invention.

FIG. 10 is a diagram illustrating the relationship between the spot size and the ratio of the vertical size (v4) of the electron beam passing hole to the horizontal size (h4) of the electron beam passing hole formed on the first electrode 4 in the cathode ray tube according to the present invention. In the drawing, a spot size of value '1' indicates that the ratio of the vertical size v4 of the electron beam passing hole to the horizontal size h4 is 1. As shown in FIG. 10, the spot size changes in accordance with the ratio of the vertical size v4 to the horizontal size h4.

For example for small a value of v4/h4 the spot size increases in proportion to an increase of the ratio of v4/h4. Then when the ratio v4/h4 becomes greater than a designated ratio, the cross over disappears and the spot size of the electron beam is reduced. After a certain point, the spot size of the electron beam increases again versus v4/h4. FIG. 10 shows that a ratio v4/h4 in the range of 1.5 to 4.3 produces a spot size of less than 0.8. An even smaller spot size is obtained when the ratio v4/h4 is in the range of 1.9 to 3.0.

Figure 11:
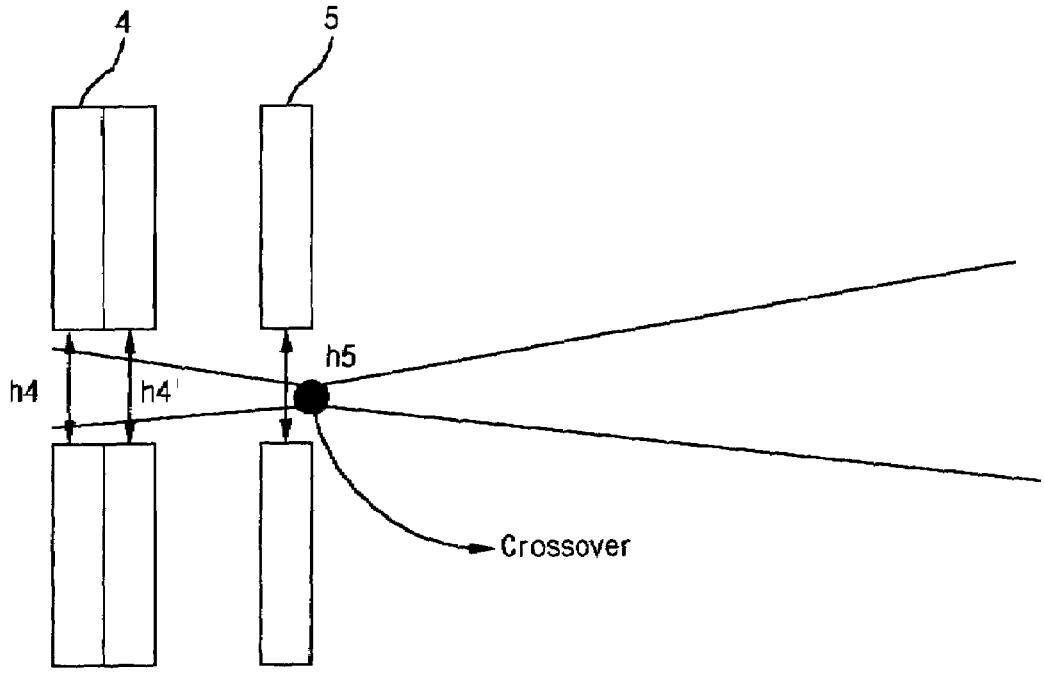
FIG. 11 is a diagram explaining the horizontal sizes of electron beam passing holes in another embodiment of the present invention.
Figure 12:
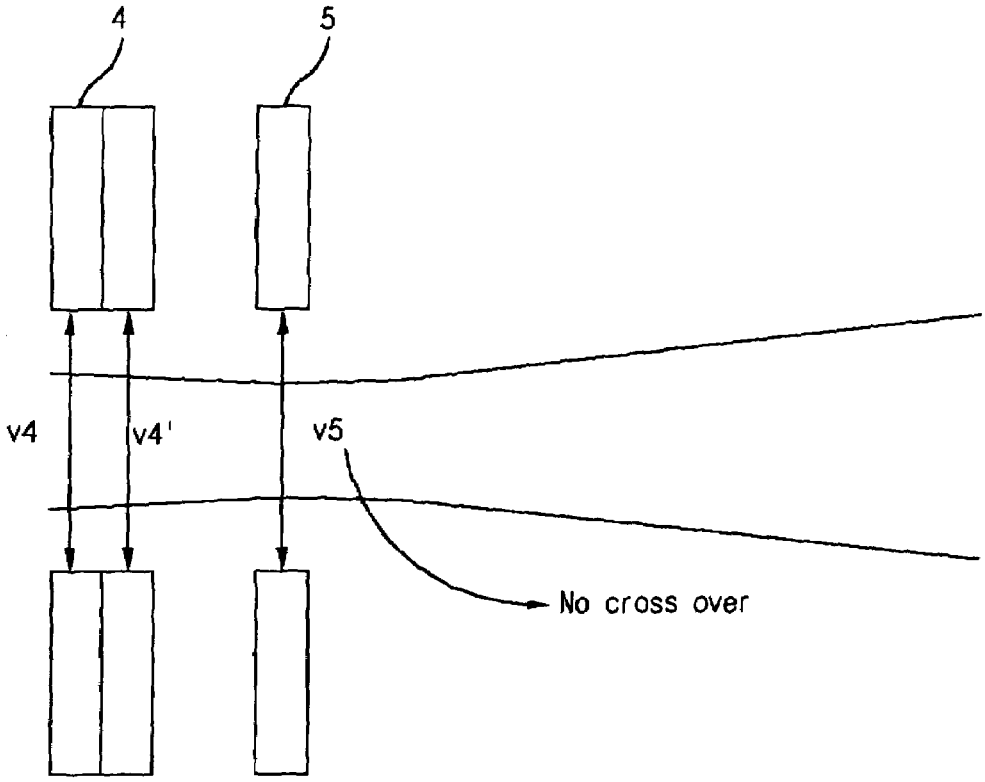
FIG. 12 is a diagram explaining the vertical sizes of electron beam passing holes in another embodiment of the present invention.

FIG. 11 is a diagram illustrating the horizontal sizes of electron beam passing holes in another embodiment of the present invention, and FIG. 12 is a diagram illustrating the vertical sizes of electron beam passing holes in another embodiment of the present invention. Referring to FIGS. 11 and 12, the horizontal size of a first side (i.e., on the cathode side) of the electron beam passing hole formed on the first electrode 4 may be h4 and the horizontal size may be h4' on a second electrode side. Likewise, the vertical size of a first side of the electron beam passing hole formed on the first electrode may be v4 and the vertical size may be v4' on a second electrode side. To get a smaller spot size, the electron beam passing hole formed on the first electrode 4 should have different sizes on the first and second sides of the first electrode, and the ratio of the vertical size v4 to horizontal size h4 of the electron beam passing hole on the first side should be equal to or less than the ratio of the vertical size v4' to horizontal size h4' of the electron beam passing hole on the second electrode side. In summary, the following relationship should be met:

$$(v4'/h4') \geqq (v4/h4).$$

Moreover, the horizontal size h4' and vertical size v4' of the electron beam passing hole formed on the first electrode 4 are greater than the horizontal size h4 and vertical size v4 of the electron beam passing hole. As shown in the drawing, a slot is formed in a direction from the plate-shaped first electrode 4 to the second electrode 5. In one embodiment of the present invention, the ratio v4/h4 may be equal to or greater than 1.5, and the ratio v4'/h4' may be equal to or greater than 1.5. This may be summarized as follows:

$$v4 \geqq 1.5\times h4,$$

$$v4' \geqq 1.5\times h4',\ \text{and}$$

$$v5 \geqq 1.5\times h5.$$

When the above conditions are met, it may be easier to reduce the vertical size of the electron beam formed on the fluorescent screen, and this makes it possible to reduce the spot size.

Figure 13:
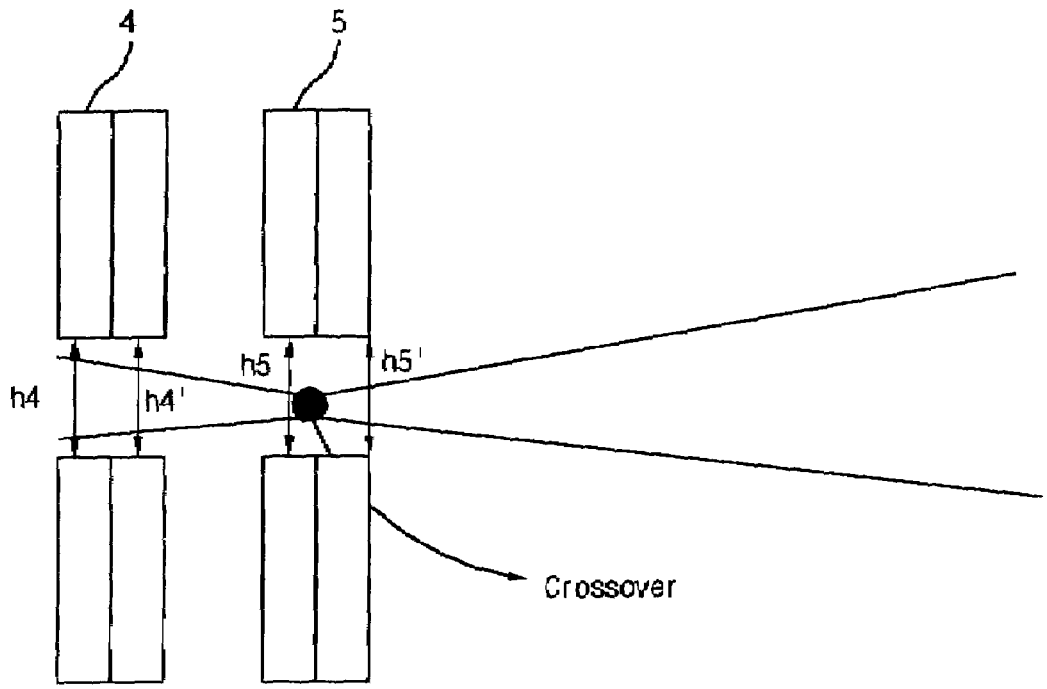
FIG. 13 is a diagram explaining the horizontal sizes of electron beam passing holes in another embodiment of the present invention.
Figure 14:
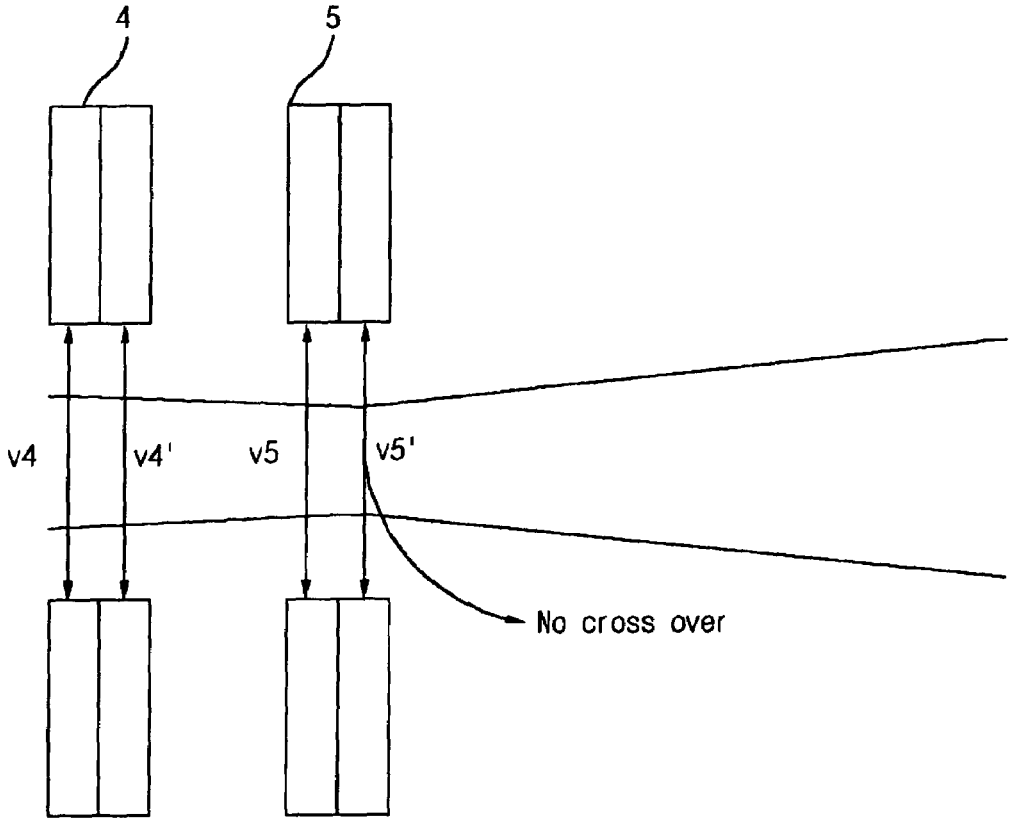
FIG. 14 is a diagram explaining the vertical sizes of electron beam passing holes in another embodiment of the present invention.

FIG. 13 is a diagram showing the horizontal sizes of electron beam passing holes in still another embodiment of the present invention, and FIG. 14 is a diagram showing the vertical sizes of electron beam passing holes in still another embodiment of the present invention. The structure of the electron beam passing hole illustrated in FIGS. 13 and 14 is similar to that of the FIGS. 11 and 12. The difference between two embodiments is that the structure of the second electrode 5 is similar to the structure of the first electrode 4, namely the second electrode has a horizontal size h5 on the first side (i.e., on the first electrode side) and the horizontal size h5' on the second side (i.e., near the third electrode side) may be different from each other. Similarly, the vertical size v5 on the first side may be different from the vertical size v5' on the second side. In other words, the slot is formed not only on the first electrode 4 but also on the second electrode. To reduce the spot size of the electron beam, the following conditions should be met:

$$v4 \geqq 1.5\times h4,$$

$$v4' \geqq 1.5\times h4',$$

$v5 \geqq 1.5 \times h5$, $v5' \geqq 1.5 \times h5'$, and $v4 \geqq v5'$.

As such, it is possible to reduce the spot size formed on the fluorescent screen by making the vertical size v4 equal to or greater than the vertical size v5'.

Figure 15:
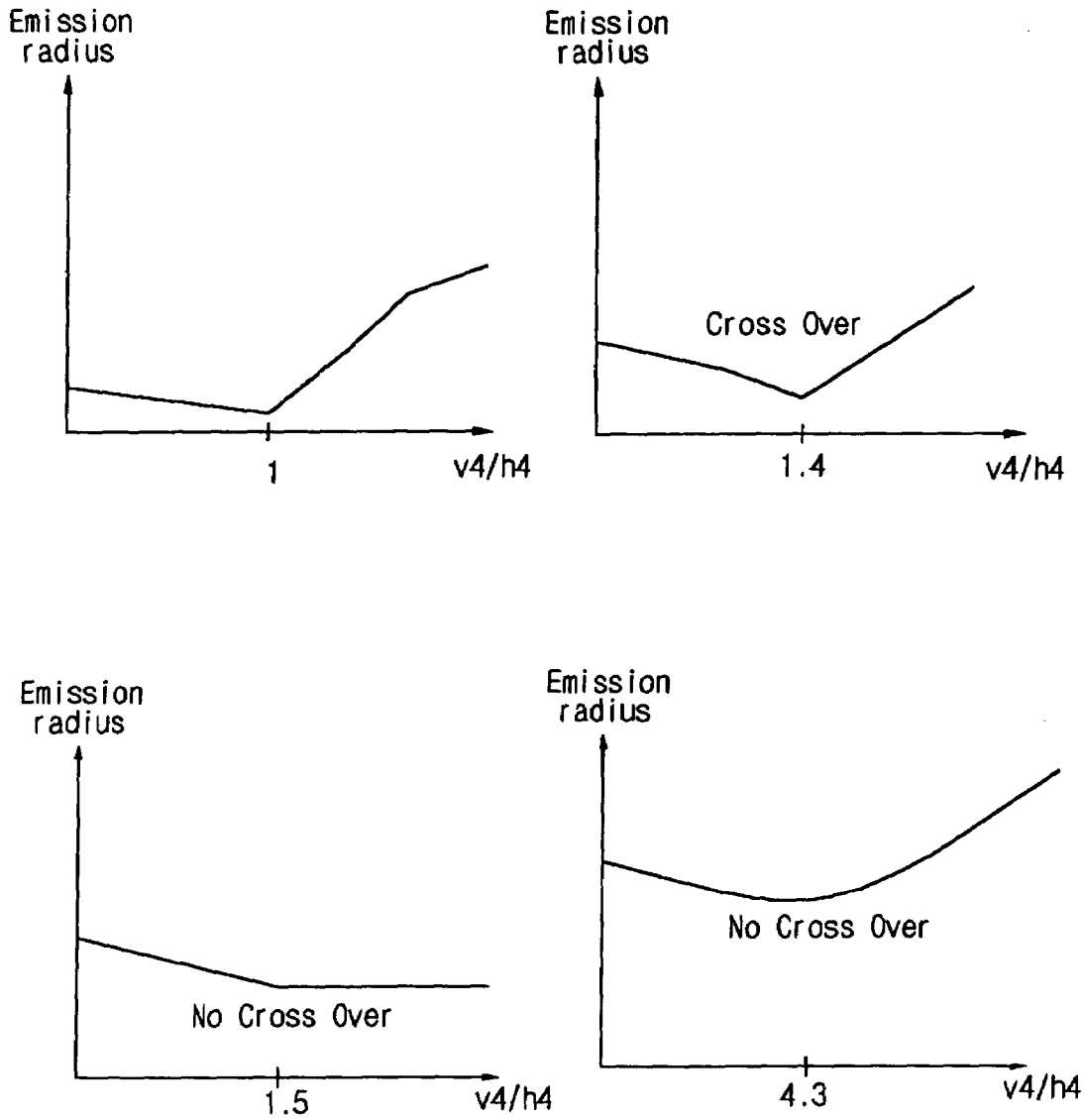
FIG. 15 is a diagram explaining the relationship between an emission radius and a ratio of the vertical size (v4) of the electron beam passing hole to the horizontal size (h4) of the electron beam passing hole formed on the first electrode of the electron gun for a cathode ray tube according to the present invention.

FIG. 15 is a diagram explaining the relationship between an emission radius and the ratio of v4/h4 of the electron beam passing hole formed on the first electrode of the electron gun for a cathode ray tube according to the present invention. When the ratio of v4/h4 increases from 1 to 1.4, the cross over as well as the emission radius in the vertical direction are increased. However, when the ratio of v4/h4 is greater than 1.5, the cross over disappears. Between 1.5 and 4.3 for the ratio, the cross over seems to increase at first and then it disappears when the ratio reaches 4.3. Also, the emission radius in the range from 1.5 to 4.3 is gradually reduced. Finally, when the ratio of v4/h4 is greater than about 4.3, the emission radius increases rapidly, and the electron beams collide with the electrode. Therefore, for one embodiment of the present invention the range for the ratio of v4/h4 may be from 1.5 to 4.3.

Figure 1:
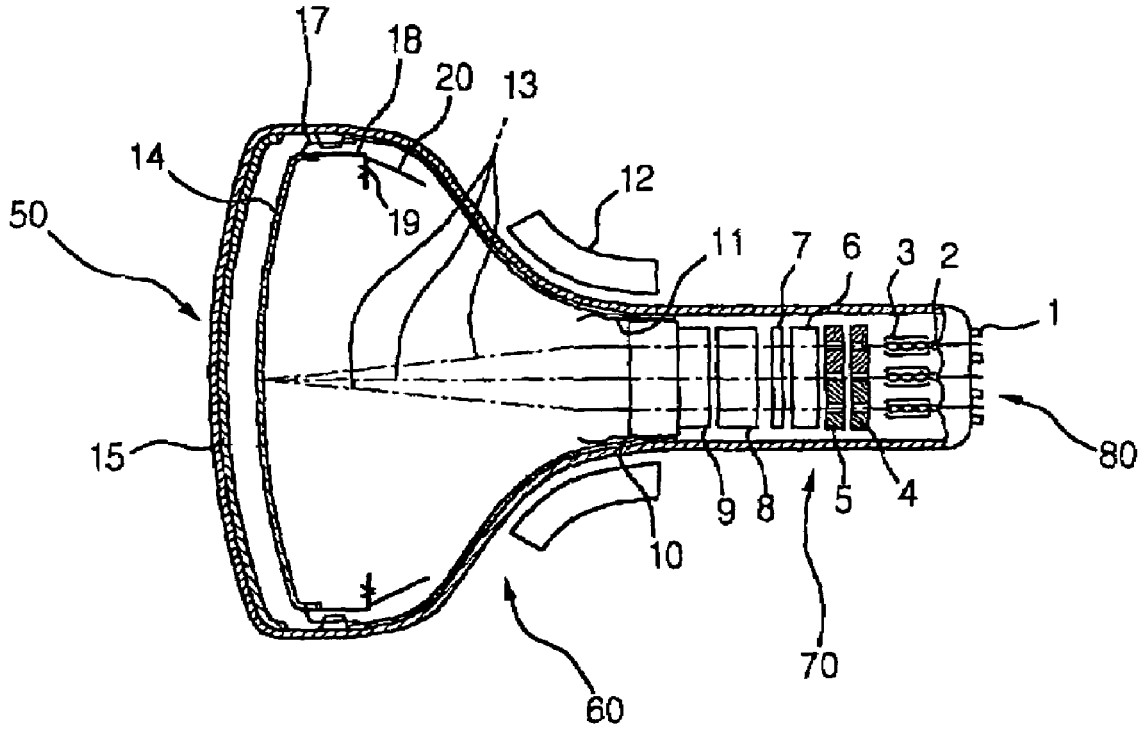
Fig.1 Related Art
FIG. 1 is a diagram explaining the structure of a cathode ray tube of the related art.
Figure 2:
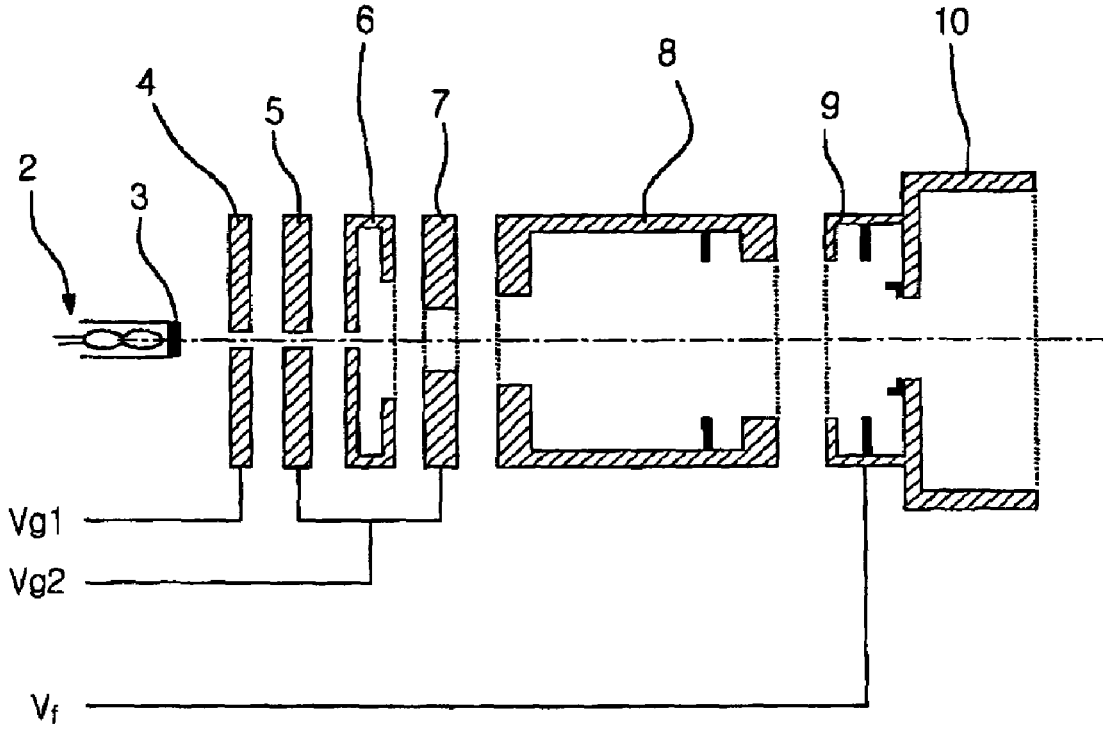
Fig.2 Related Art
FIG. 2 is a diagram explaining a structure of an electron gun of the related art.
Figure 3:
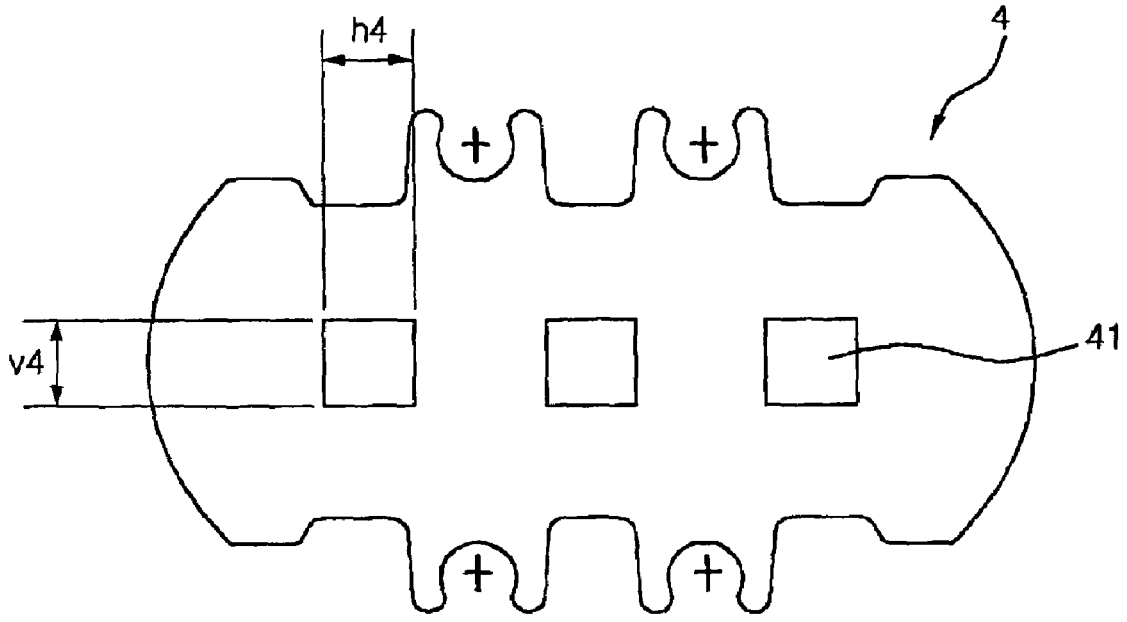
Fig.3 Related Art
FIG. 3 is a diagram explaining electron beam passing holes on a first electrode composing a triode portion of the electron gun.
Figure 4:
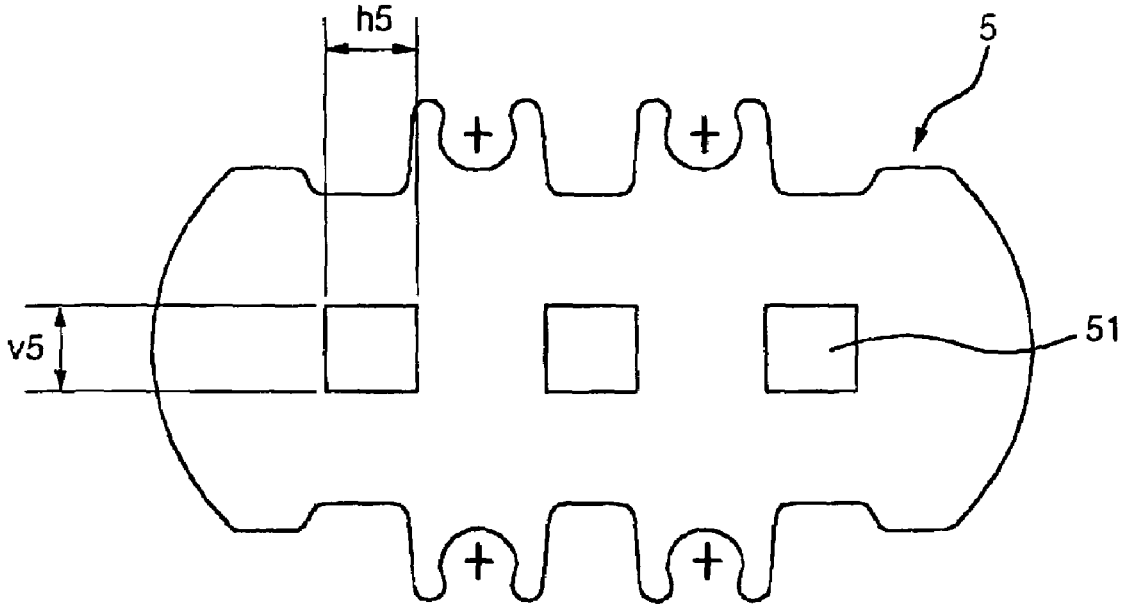
Fig.4 Related Art
FIG. 4 is a diagram explaining electron beam passing holes on a second electrode composing a triode portion of the electron gun.
Figure 5:
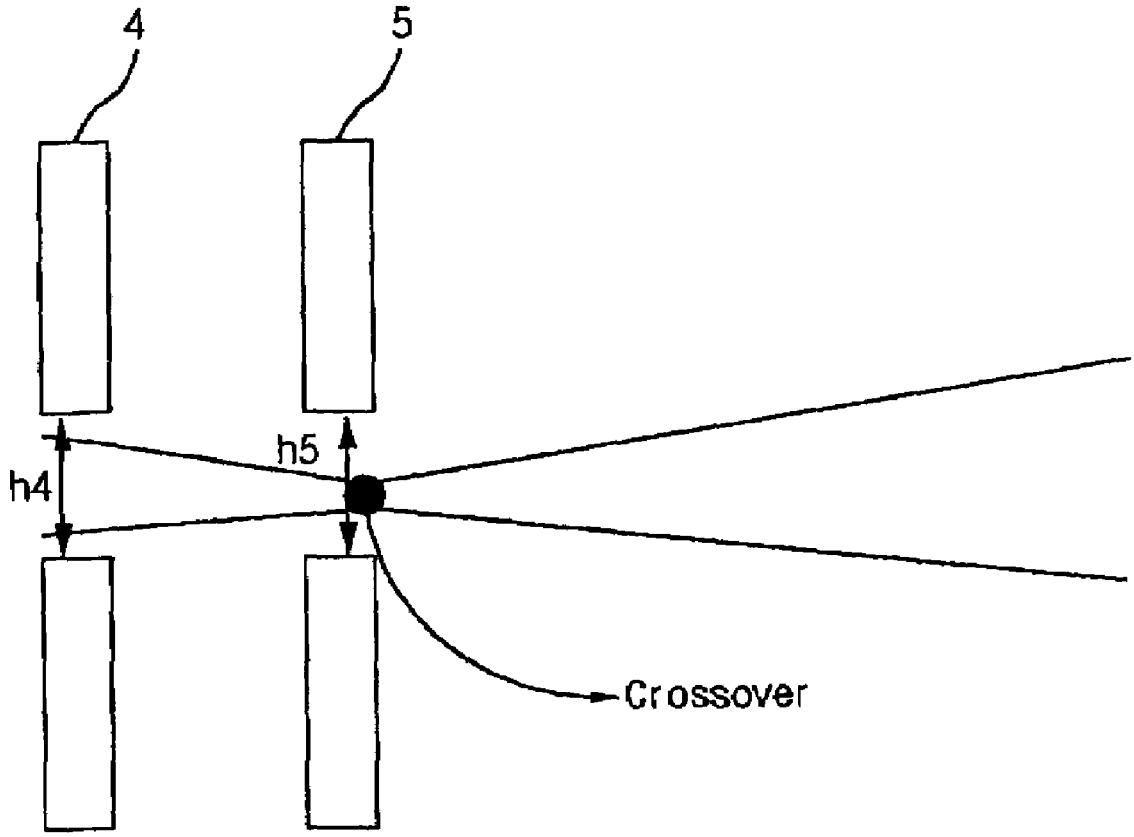
Fig.5 Related Art
FIG. 5 is a diagram explaining horizontal sizes of the electron beam passing holes on the first and second electrodes of the triode portion of the electron gun.
Figure 6:
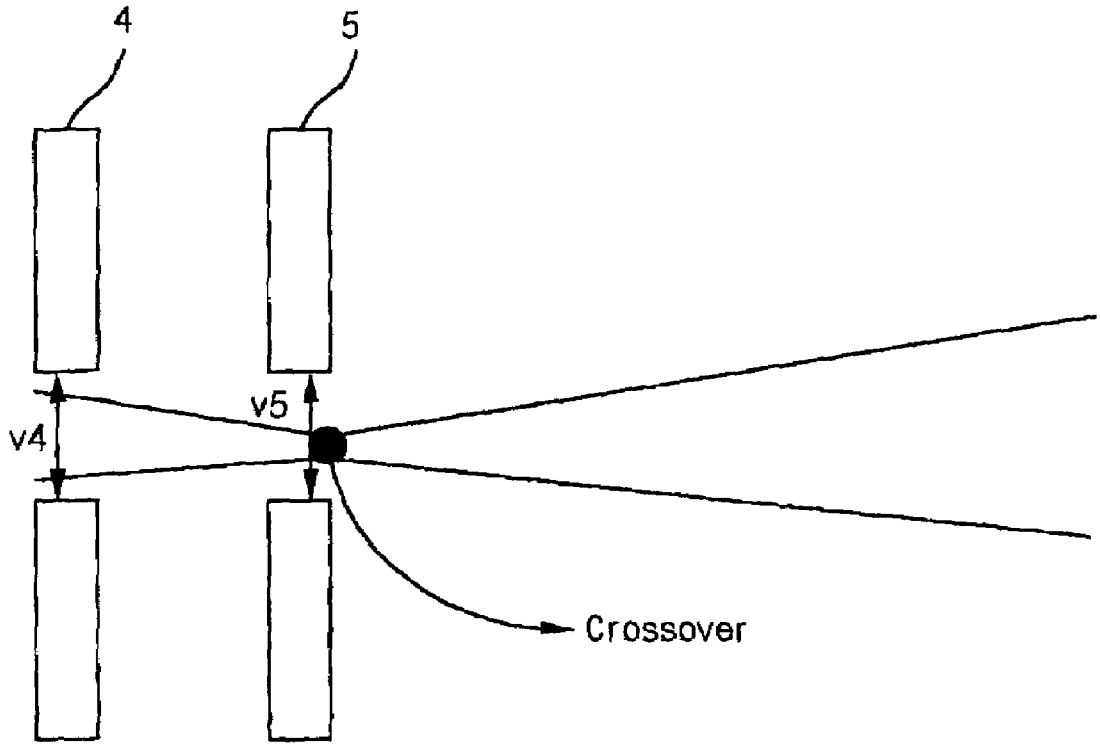
Fig.6 Related Art
FIG. 6 is a diagram explaining vertical sizes of the electron beam passing holes on the first and second electrodes of the triode portion of the electron gun.
Figure 7:
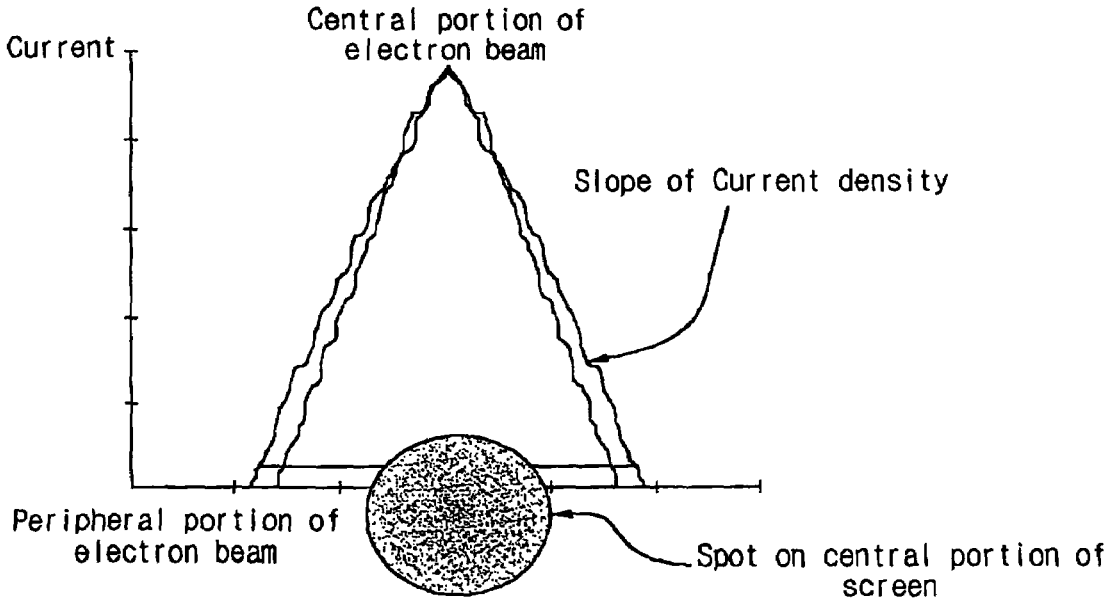
Fig.7 Related Art
FIG. 7 is a diagram explaining the relationship between the spot formed on a central portion of the screen and current density in the cathode ray tube.
Figure 16:
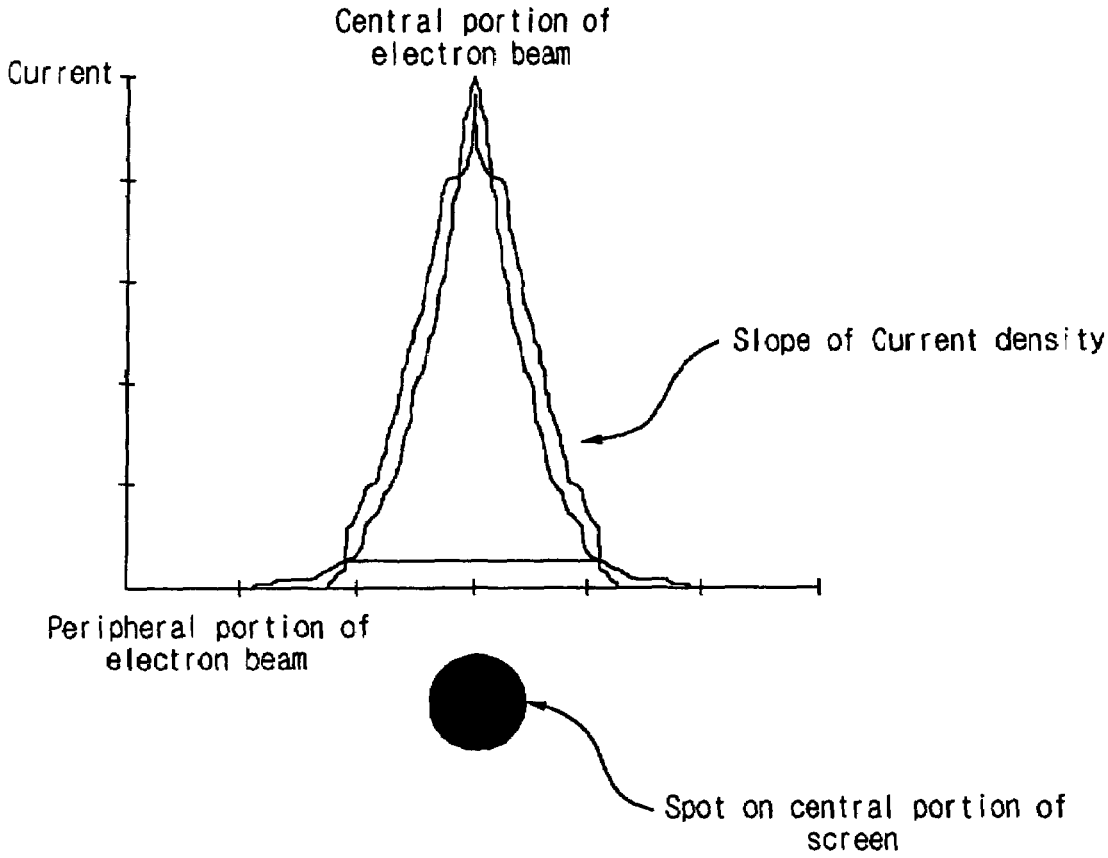
FIG. 16 is a diagram explaining the relationship between a spot and a current density on a central portion of the screen in a cathode ray tube according to the present invention.

FIG. 16 is a diagram explaining the relationship between a spot and current density on a central portion of the screen in a cathode ray tube according to the present invention. Comparing FIG. 6 to FIG. 7, it is evident that the spot size on the central portion of the screen is noticeably reduced, and the slope of the current density is now much steeper. It is better to have a smaller beam spot size and a higher current density to be applied to a high brightness and wide angle cathode ray tube.

In conclusion, increasing the vertical size of the electron beam passing holes formed on the first and second electrodes means that the life span of the cathode does not have to be shortened and it becomes much easier to manufacture the electrode. Moreover, the present invention may be advantageously used for improving the brightness of the cathode ray tube by emitting electron beams with a high current density. Further, because the spot size on the screen is now 30–40% smaller than that of the related art, resolution of the cathode ray tube may be greatly improved as well.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A cathode ray tube mounted with an electron gun comprising:

a triode portion consisting of a cathode;

first and second electrodes for controlling and accelerating electron beams emitted from the cathode; and a plurality of focus electrodes for focusing the electron beams;

wherein a ratio of a vertical size to a horizontal size of an electron beam passing hole on the first electrode ranges from 1.9 to 3.0.

2. The cathode ray tube of claim 1, wherein the vertical size of the electron beam passing hole on the second electrode is greater than a horizontal size of the electron beam passing hole on the second electrode.

3. The cathode ray tube of claim 2, wherein a ratio of a vertical size to a horizontal size of an electron beam passing hole on the second electrode is greater than or equal to 1.5.

4. The cathode ray tube of claim 1, wherein the electron beam passing hole on the first electrode has a different size on a first side and on a second side, and a ratio of a vertical size to a horizontal size of the electron beam passing hole on the first side is less than a ratio of a vertical size to a horizontal size of the electron beam passing hole on the second side.

5. The cathode ray tube of claim 1, wherein the triode portion is formed in a manner that the electron beams cross over in a horizontal direction only.

6. The cathode ray tube of claim 1, wherein the electron beam passing hole on the first electrode is rectangular.

7. The cathode ray tube of claim 1, wherein the electron beam passing hole on the second electrode is rectangular.

8. The cathode ray tube of claim 1, wherein a vertical size of the electron beam passing hole on the first electrode near the cathode side is greater than or equal to a vertical size of the electron beam passing hole on the second electrode near a third electrode side.

9. The cathode ray tube of claim 1, wherein a dynamic voltage is applied to at least one of the plurality of focus electrodes.

10. The cathode ray tube of claim 1, wherein an electron beam passing hole on a third electrode among the plurality of focus electrodes is circular.

11. The cathode ray tube of claim 1, wherein electron beam passing holes on the first and second electrodes are rectangular, and an electron beam passing hole on a third electrode is circular.

12. A cathode ray tube with an electron gun comprising:

a triode portion having a cathode;

a first electrode for controlling and accelerating electron beams emitted from the cathode with an electron beam passing hole that has a first horizontal and vertical size on a first side near the cathode and a second horizontal and vertical size on a second side opposite the first side;

a second electrode for controlling and accelerating electron beams emitted from the cathode with an electron beam passing hole that has a third horizontal and vertical size; and a plurality of focus electrodes for focusing the electron beams;

wherein a ratio of the second vertical size to the second horizontal size of the second side opposite the first side of the first electrode is greater than a ratio of the first vertical size to the first horizontal size of the first side of the first electrode; and wherein a ratio of the vertical size to the first horizontal size is greater than 1.5, a ratio of the second vertical size to the second horizontal size is greater than 1.5, and a ratio of the third vertical size to the third horizontal size is greater than 1.5.

13. The cathode ray tube of claim 12, wherein the second electrode for controlling and accelerating electron beams emitted from the cathode with an electron beam passing hole that has a third horizontal and vertical size on a first side towards the first electrode and a fourth horizontal and vertical size on a second side opposite the first side, and wherein a ratio of the fourth vertical size to the fourth horizontal size is greater than 1.5, and the first vertical size is greater than the fourth vertical size.

14. The cathode ray tube of claim 12, wherein the ratio of the first vertical size to the first horizontal size is in the range of greater than 1.5 and less than or equal to 4.3.

15. The cathode ray tube of claim 12, wherein the ratio of the first vertical size to the first horizontal size is in the range of about 1.9 to 3.0.

16. The cathode ray tube of claim 12, wherein the triode portion is formed in a manner that the electron beams cross over in a horizontal direction only.

17. The cathode ray tube of claim 12, wherein the electron beam passing hole on the first electrode is rectangular.

18. The cathode ray tube of claim 12, wherein the electron beam passing hole on the second electrode is rectangular.

19. The cathode ray tube of claim 12, wherein a vertical size of the electron beam passing hole on the first electrode near the cathode side is greater than or equal to a vertical size of the electron beam passing hole on the second electrode near a third electrode side.

20. The cathode ray tube of claim 12, wherein a dynamic voltage is applied to at least one of the plurality of focus electrodes.

21. The cathode ray tube of claim 12, wherein an electron beam passing hole on a third electrode among the plurality of focus electrodes is circular.

22. The cathode ray tube of claim 12, wherein electron beam passing holes on the first and second electrodes are rectangular, and an electron beam passing hole on a third electrode is circular.

* * * * *